US005915703A

United States Patent [19]

Wrike

[11] Patent Number: 5,915,703

[45] Date of Patent: Jun. 29, 1999

[54] IN-LINE SKATE AXLE AND RELATED ASSEMBLY METHOD

[75] Inventor: Michael C. Wrike, Jamestown, N.C.

[73] Assignee: Rike Industries, Inc., Jamestown, N.C.

[21] Appl. No.: 08/781,076

[22] Filed: Jan. 9, 1997

[51] Int. Cl.[6] ..... A63C 17/06

[52] U.S. Cl. ..... 280/11.22; 280/11.27; 301/5.3

[58] Field of Search ..... 301/5.3, 5.7, 110.5, 301/114; 280/11.22, 11.27, 11.28

[56] References Cited

U.S. PATENT DOCUMENTS

| | | | |
|---|---|---|---|
| D. 354,539 | 1/1995 | Meibock et al. | D21/226 |
| 1,217,761 | 2/1917 | Hartman | 301/5.3 X |
| 1,406,643 | 2/1922 | Hardy | 301/5.3 X |
| 3,880,441 | 4/1975 | Silver | 280/11.22 |
| 3,900,203 | 8/1975 | Kukulowicz | 280/11.2 |
| 4,418,929 | 12/1983 | Gray | 280/11.23 |
| 4,657,265 | 4/1987 | Ruth | 280/7.13 |
| 4,659,095 | 4/1987 | Halvorsen | 280/11.27 |
| 4,666,169 | 5/1987 | Hamill et al. | 280/11.23 |
| 4,932,675 | 6/1990 | Olson et al. | 280/7.13 |
| 5,046,746 | 9/1991 | Gierveld | 280/11.22 |
| 5,092,614 | 3/1992 | Malewicz | 280/11.22 |
| 5,129,663 | 7/1992 | Soo | 280/7.14 |
| 5,184,834 | 2/1993 | Yu | 280/7.13 |
| 5,193,827 | 3/1993 | Olson | 280/7.13 |
| 5,199,726 | 4/1993 | Willett | 280/11.27 |
| 5,251,920 | 10/1993 | McHale | 280/11.19 |
| 5,253,884 | 10/1993 | Landers | 280/11.27 |
| 5,271,633 | 12/1993 | Hill, Jr. | 280/11.22 |
| 5,277,437 | 1/1994 | Moats | 280/11.23 |
| 5,308,152 | 5/1994 | Ho | 301/5.3 |
| 5,314,199 | 5/1994 | Olsen et al. | 280/7.13 |
| 5,331,752 | 7/1994 | Johnson et al. | 36/115 |
| 5,348,320 | 9/1994 | Gay | 280/11.22 X |
| 5,503,413 | 4/1996 | Belogour | 280/11.22 |
| 5,549,310 | 8/1996 | Meibock et al. | 280/11.22 |
| 5,660,401 | 8/1997 | Yi | 280/11.22 |
| 5,741,019 | 4/1998 | Lu | 301/5.3 X |

FOREIGN PATENT DOCUMENTS

| | | | |
|---|---|---|---|
| 684055 A1 | 11/1995 | European Pat. Off. | 280/11.22 |

*Primary Examiner*—Lanna Mai
*Assistant Examiner*—Michael Mar
*Attorney, Agent, or Firm*—Myers Bigel Sibley & Sajovec

[57] ABSTRACT

A three piece in-line skate axle and related assembly method for in-line roller skates. Advantageously, the three piece configuration provides improved load bearing stress points along the axle. In addition, the center member can be varied in size according to a specific skate design and assembled to the common two end members. This interchangeability reduces the amount of component inventory a manufacturing facility needs to carry. Further, the amount of high strength (and high cost) material can be minimized to reduce manufacturing costs associated therewith.

19 Claims, 3 Drawing Sheets

IN-LINE SKATE AXLE AND RELATED ASSEMBLY METHOD

FIELD OF THE INVENTION

The present invention relates to in-line roller skates and more particularly relates to axles for mounting the wheels to the skate frame.

BACKGROUND OF THE INVENTION

In-line roller skates are configured with a frame which supports a plurality of in-line rollers. The frame is attached to a boot or shoe and includes two sidewalls which extend downwardly and define a cavity therebetween. Typically, each of the rollers is rotatably supported by an axle which is transversely inserted through apertures aligned in opposed locations of the sidewalls. The axles extend across the cavity to enable the wheels or rollers to rotate with respect thereto. Thus, the axles can be exposed to large tensile, bending, and impact forces, especially at critical joints, and therefore must be designed to withstand these types of loads.

Previously, two-piece axles and three-piece axles have been employed to assemble the wheels to the associated frame component. The two-piece axle includes an integral first member with a barrel-like portion which extends across the length of the cavity defined by the two sidewalls. The first member includes an internal threaded portion which receives a second member. Each of the first and second members have heads which are positioned on the outer surfaces of the sidewalls to secure the axles thereto. Unfortunately, this configuration positions the thinnest portion of the shaft within the aperture of the sidewall, which concentrates stress at this thinnest portion and therefore can reduce the strength and durability of the axle significantly. In addition, for each differently sized frame or different roller configuration (e.g., roller size), a different specifically-sized first member and/or second member must be carried in inventory. The increased inventory can, in turn, increase the manufacturing costs associated therewith.

One example of a roller axle is proposed by Gierveld in U.S. Pat. No. 5,046,746. As described, the axle is formed by two threaded bolts which directly engage with a bearing shaft component. Unfortunately, like the two-piece axle described above, this configuration places the thinnest portion of the axle within the aperture of the sidewall, which can concentrate stress at this thinnest portion and therefore reduce the strength of the axle. This design also employs multiple relatively complex axle-to-frame mounting components. Further disadvantageously, this design provides limited interchangeability with alternatively configured frames.

OBJECTS AND SUMMARY OF THE INVENTION

In view of the foregoing, it is a first object of the present invention to provide an economical and easily manufactured axle that is simply interchanged between frame or roller configurations.

It is a further object of the present invention to provide an axle which positions points of concentrated stress at increased strength areas.

It is another object of the present invention to provide an axle that utilizes outwardly accessible deepest screw heads to minimize the potential for stripped threads during assembly and disassembly.

It is yet another object of the present invention to provide an axle which allows for cost-effective use of high strength materials.

These and other objects, advantages, and features are provided by the present invention, which includes a three piece axle assembly for use with an in-line roller skate. The axle comprises a first bolt having opposing head and end portions and a shoulder disposed therebetween. The shoulder is sized and configured to be received within a corresponding receptacle in an in-line skate frame. The end portion of the first bolt is threaded. The in-line axle also includes a cylindrical shaft having opposing end portions, with one of the end portions being threadably engaged with the first bolt end portion. The third piece of the three-piece axle is a second bolt configured to be received within a corresponding receptacle in an in-line skate frame. The bolt also has opposing head and end portions. The end portion is threadably engaged with the shaft end opposite the first bolt. Because the shoulder of the first bolt is positioned within the receptacle of the in-line skate frame, the axle provides more material at this high stress point, which leads to increased strength. It is preferred that the second bolt also have a shoulder disposed between its head and end portions to receive the opposing sidewall receptacle; again, the increased material at this high stress location can increase the strength of the axle.

Preferably the first and second bolts are interchangeable, and more preferably have the same configuration and are firmed from the same material. This can decrease inventory costs associated with non-standard and non-interchangeable components. It is also preferred treat the shaft be made from a different material than the bolts, which enables the axle to be selectively manufactured with high-strength materials only in high load areas.

It is also preferred that the axle bolt head portion includes an inwardly-directed recess which is configured to capture a hex head assembly tool. Advantageously, this head recess will provide more tool engagement surface and help minimize thread wear.

This axle can be employed in an in-line skate that includes conventional boot, frame, and downwardly-extending sidewalls that define a cavity. Preferably, the sidewalls have a plurality of receptacles transversely disposed along the length of the sidewalls with the receptacles of one sidewall being aligned with the receptacle of the other sidewall. A plurality of the three-piece axles, each received into corresponding aligned receptacles, extend across the cavity. The first bolt shoulder of which is received within a corresponding receptacle in one of the sidewalls, and the second bolt shoulder is received by a corresponding receptacle of the other sidewall. The cylindrical shaft is threadably engaged with the first and second belt end portions. The axles then support a plurality of wheels, each of which is rotatably mounted on a corresponding one of the axles between the sidewalls. The foregoing and other aspects of the present invention are explained in (detail in the specification set forth below.

DETAILED DESCRIPTION OF THE INVENTION

The present invention will now be described more fully hereinafter with reference to the accompanying drawings, in which preferred embodiments of the invention are shown. This invention, may however, be embodied in many different forms and should not be construed as limited to the embodiments set forth herein. Rather, these embodiments are provided so that this disclosure will be thorough and complete, and will fully convey the scope of the invention to those skilled in the art.

The present invention relates to an in-line skate axle, in-line skate, and associated method for mounting an in-line skate axle to a frame. In the description of the present invention that follows, certain terms are employed to refer to the positional relationship of certain structures relative to other structures. As used herein, the term "longitudinal" and derivatives thereof refer to the general direction defined by the longitudinal axis of the boot or other footwear associated with an in-line skate that extends between the toe and the heel of the boot. As used herein, the terms "outer", "outward", "lateral" and derivatives thereof refer to the direction defined by a vector originating at the longitudinal axis of the boot and extending horizontally and perpendicularly thereto. Conversely, the terms "inner", "inward", and derivatives thereof refer to the direction opposite that cf the outward direction. Together the "inward" and "outward" directions comprise the "transverse" direction.

Figure 1:
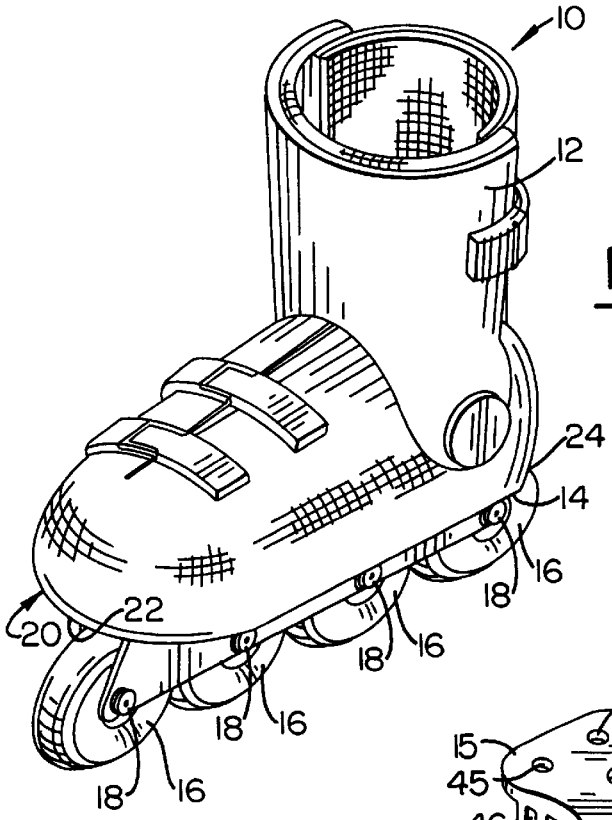
FIG. 1 is a perspective view of an assembled in-line skate of the present invention.

Referring now to the drawings, an in-line, roller skate according to the present invention, generally designated at 10, is illustrated in FIG. 1. The skate 10 includes a boot 12 (which can also be a shoe or other similar footwear), a frame 14 attached to the underside thereof and a plurality of wheels 16 that are rotatably and removably mounted on the frame 14 for rotation about their respective axles 18.

The boot 12 includes a sole surface 20 having a toe portion 22 and a heel portion 24 to which the frame 14 is attached. The frame assembly 14 can be configured to include a frame platform 15 which is attached to and extends downwardly from the sole of the boot 20. As such, the frame platform 15 can be formed either integrally with the boot (e.g., molded) or assembled to the boot with conventional fastening techniques including screws, high strength adhesives, and the like. Further, as described herein, the frame platform 15 which can be either a single or multi-piece component (as is illustrated herein). If a single piece platform 15 is employed, it is preferred that it be substantially continuous and extend the length of the shoe or boot.

Figure 2:
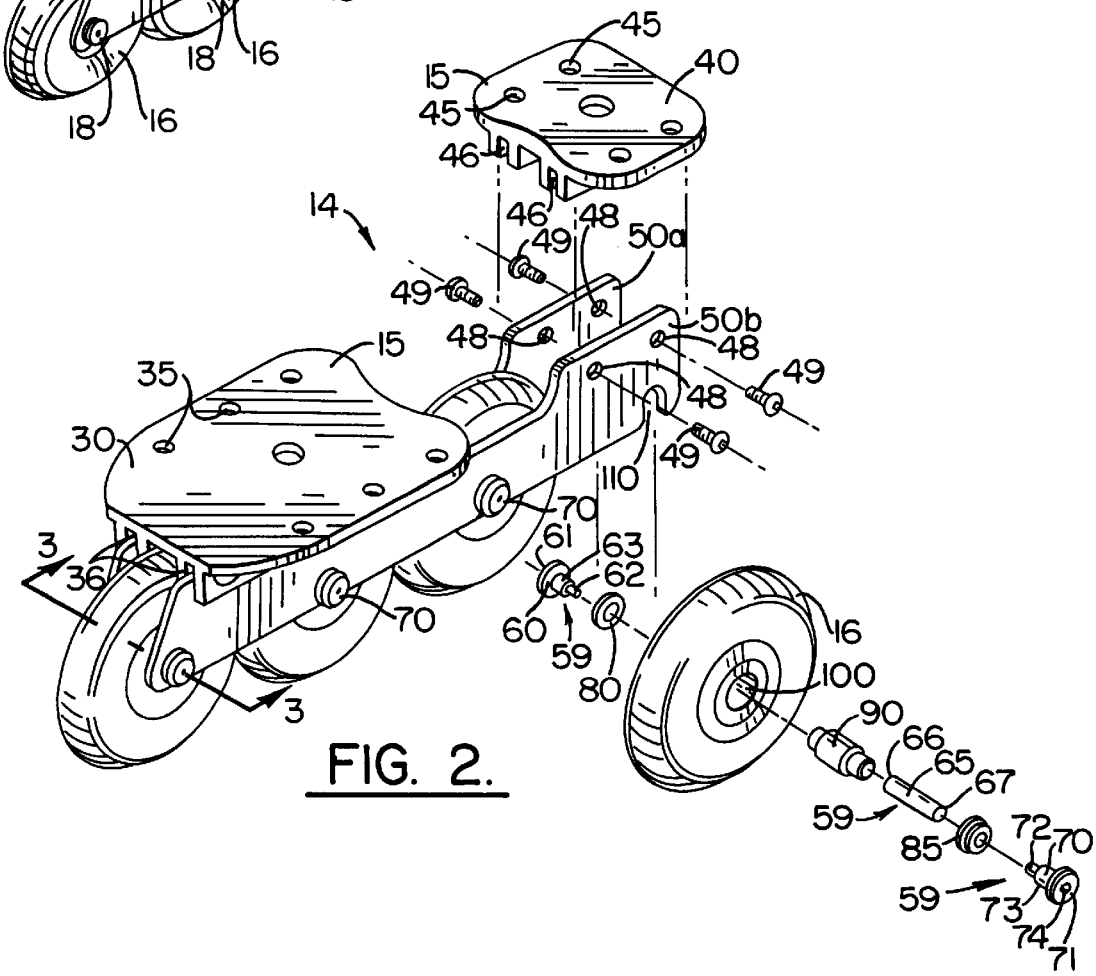
FIG. 2 is an exploded perspective view of a skate frame and axle of the present invention.

As illustrated in FIG. 2, a preferred embodiment of the frame 14 includes a multi-piece frame platform 15 including E. For plate 30 and a heel plate 40. Preferably, the frame assembly 14 also includes a pair of substantially planar downwardly extending sidewalls 50*a*, 50*b*. As illustrated, the sidewalls 50*a*, 50*b* are received into corresponding ones of the downwardly extending cavities 36, 46 of each of the respective frame components 30, 40. The sidewalls 50*a*, 50*b* are then a signed with a plurality of laterally spaced openings (not shown) in the walls of the cavities and corresponding openings 48 in the upper portions of the sidewalls, and attached to the toe and heel plates 30, 40 via a plurality of transversely inserted bolts 49.

As illustrated in FIG. 2, in order to assemble the boot 12 and boot associated or frame platform components 15 together, a bolt is inserted through each of a plurality of openings 35 disposed about the horizontal surface of a toe plate 30. These bolts are then inserted into matching threaded openings disposed along the toe portion 22 of the sole surface 20. Similarly, bolts are inserted through each of a plurality of openings 45 disposed about the horizontal surface of the heel plate 40, and are inserted into matching threaded openings disposed along the heel portion 24 of the sole surface 20. However, as would be readily understood by those skilled in the art, other alternative fastening means, such as rivets or high strength adhesives, can be used to secure the wheel frame 14 to the sole surface of the boot. Once the boot 12 and its associated frame components 15 are assembled, they generally remain attached and in place.

Although the illustrated frame is preferred, those skilled in this art will appreciate that other frame configurations, such as those disclosed in co-pending and co-assigned U.S. Patent Applications filed concurrently herewith entitled TOE PLATE WITH DUAL FLANGIES FOR IN-LINE SKATE FRAME (Attorney Docket Number 5565-3) and IN-LINE SKATE WITH QUICK RELEASE SIDEWALLS AND RELATED ASSEMBLY METHODS (Attorney Docket Number 5565-8), and U.S. Pat. Nos. 5,271,633 to Hill, Jr. and 5,092,614 to Malewicz, are also suitable for use with the present invention. The disclosure of each of these patents and patent applications are hereby incorporated herein by reference in their entireties.

As illustrated by the exploded view in FIG. 2, a three-piece axle 59 comprises a first bolt 60, a cylindrical shaft 65, and a second bolt 70. The axle 59 holds the rotatable wheel 16 and associated bearing component 90 and spacers 80, 85. The first bolt 60 includes opposing,, head and end portions 61, 62 and a shoulder portion 63 therebetween. Similarly, the second bolt 70 includes opposing head and end portions 71, 72 and a shoulder portion 73 therebetween. Preferably, the first and second bolts 60, 70 have identical configurations to provide for interchangeable assembly of the components and a corresponding reduction in inventory carrying costs (as well as potential labor sorting costs).

The shoulders 63, 73 of each of the bolts 60, 70 are preferably about the same length as the threaded end portions 62, 72 of the bolt. This shoulder and thread length can vary, but it is preferred that they be selected to position high stress points at positions of high strength along the assembled axle and thereby increase load capacity. For example, the shoulders 63, 73 are preferably and illustratively positioned within receptacles in the sidewalls 50*a*, 50*b*, and so should at least be sufficient in length to span the thickness of the sidewalls, as they are high load areas of the axle 59. Additionally, a long shoulder portion allows for a recess 64, 74 to be formed in the head 61, 71 of the bolt and extend a predetermined distance into the shoulder portion. This recess, in turn, can be formed to capture a hex head tool, thereby providing increased surface area to engage with the tool. For example, the wide shoulder can support a recess accessible by a deepest 5⁄32 hex head driver. Thus, the recess can reduce the potential for stripped Threads during assembly and disassembly of the axles.

Figure 4:
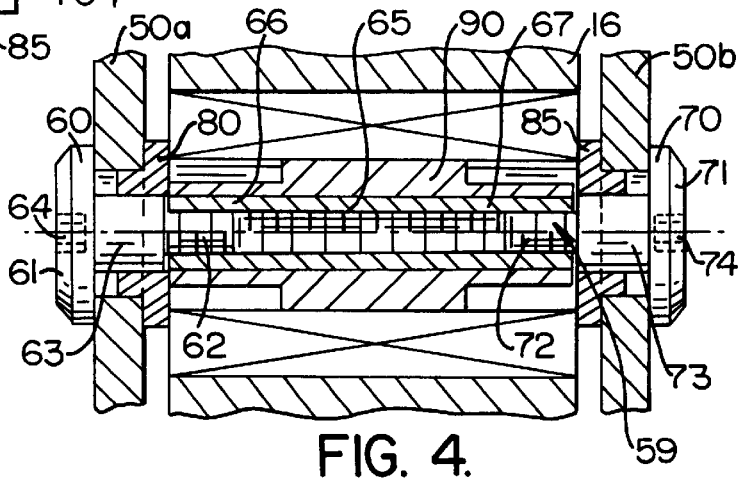
FIG. 4 is an enlarged partial section view taken along line 4—4 of FIG. 3, illustrating an axle according to the present invention.

As shown in the cross-sectional view of FIG. 4, the two axle bolts 60, 70 are assembled to opposing ends 66, 67 of the cylindrical shaft 65. Preferably, the first and second bolts

60, 70 are threadably assembled to the shaft 65. Also preferably the shaft 65 is configured to receive the entire threaded end portions 62, 72 of each of the bolts 60, 70 so as to provide a substantially continuous flush outer surface of the three components when assembled theretogether. This provides a smooth support surface for the bearing component 90 and spacers 80, 85 and reduces the likelihood of stress concentration along the assembled axle. Further, the shaft 65 is configured to receive each of the mutably threaded bolts 60, 70. Preferably, the shaft 65 includes opposing threaded ends for receiving the threaded bolts. As such, the shaft 65 can be configured in many alternative configurations. For example, the shaft 65 can be threaded throughout its length, or alternatively can have a solid middle section or can be hollowed out intermediate of the threaded end portions. The continuous thread and the hollow cylinder embodiments removes material and can reduce component weight.

Figure 3:
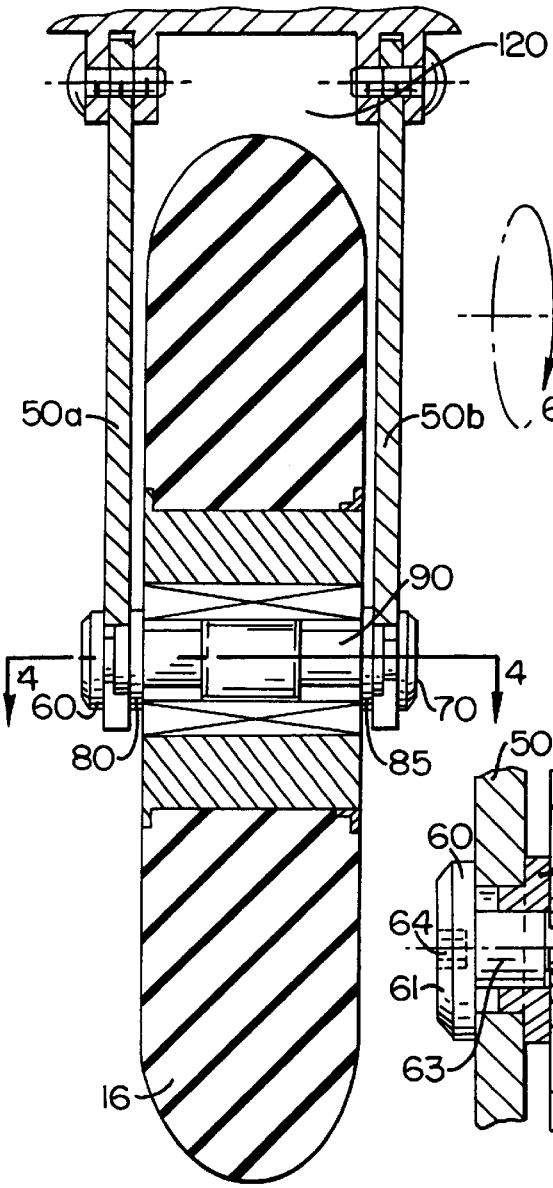
FIG. 3 is an enlarged section view of an in-line roller skate taken along line 3—3 of FIG. 2, illustrating the assembly of the skate frame, axle, and roller.
Figure 5:
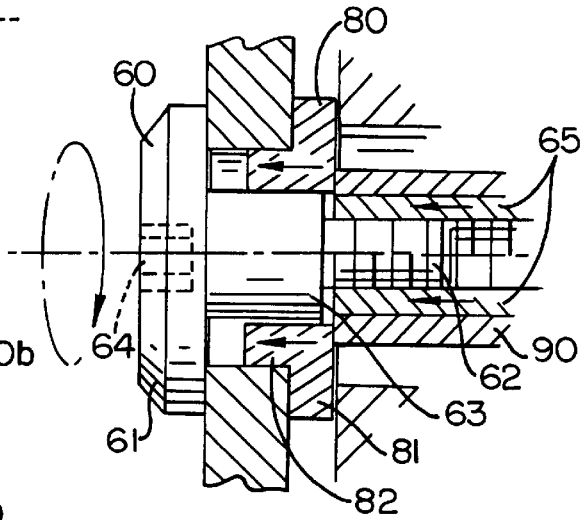
FIG. 5 is a greatly enlarged partial section view of the frame and axle of FIG. 4 illustrating the assembly of the axle.

As illustrated in FIGS. 3 and 4, the shaft 65 and shoulder portions 63, 73 define the underlying axle support length available for the wheel. Advantageously, the diameter and length of the bolts and the shaft can vary. For example, the axle can employ a longer shoulder portion and a shorter cylindrical shaft portion. Preferably, the bolts and respective shoulder portions are sized to provide sufficient structural strength and desired structural load distribution while also maintaining a minimum length to reduce weight associated therewith. Alternatively, when forming one of the components from a light weight high strength material such as titanium, the cost for the material is typically much higher than for standard materials. Thus, it can be advantageous to employ as little of the expensive material as possible. The proper axle size can still be maintained by extending the size of the other components. For example, one preferred configuration/material design is for relatively small zinc plated steel or titanium bolts and a correspondingly sized larger shaft formed of 7075 T-6 aluminum. An example of a suitable shaft to shoulder ratio is 3/1, with a shaft length typically in the range of about 0.5–1.25 inches, preferably about 0.75 inches Correspondingly, the shoulder portion of the bolt is preferably about 0.16–0.41 inches and more preferably about 0.25 inches long.

Further, it will be appreciated that from frame to frame, the wheel profiles and or the gap between frame sidewalls may vary. Advantageously, the present invention can be employed with a variety of frame configurations. The shaft 65 can be provided in smaller (or larger lengths) to adjust for the frame gap. Manufacturers can be spared the cost of stocking multiple components for multiple frame configurations. Advantageously, the first and second bolts can be used interchangeably with the varying sized cylindrical shafts.

As illustrated in FIGS. 3 and 4, the first bolt 60, the shaft 65, and the second bolt 70 are assembled to the frame side walls 50*a*, 50*b* and extend laterally across the cavity 120 defined by the opposing sidewalls 50*a*, 50*b*. As shown in FIG. 4, the bearing component 90 and the spacers 80, 85 are assembled onto the top of the axle 59. The wheel 16 is mounted to the bearing component 90 and is centrally positioned in the cavity 120 by use of a pair of spacers 80, 85. As shown the spacers 80, 85 are separate components; however, the invention is not limited thereto. For example, the spacers 80, 85 can be formed integrally to the sidewalls to define predetermined tolerances for the rotating wheel relative to the frame. Preferably, when frame configurations are employed with non-planar sidewalls, the spacers are fixedly attached or built into the sidewalls 50*a*, 50*b*. Examples of spacer attachment techniques include, but are not limited to, molding, brazing, welding, and casting.

In a preferred embodiment, each of the spacers 80, 85 has a larger end 81, 86 and a stepped-down shoulder 82, 87. As shown, the spacers 80, 85 are assembled onto the axle 59 such that the stopped-down portion faces the head of the respective axle bolt 60, 70. In this manner, each of the sidewalls 50*a*, 50*b* rides (at least partially) on this stepped-down portion of the spacer. Alternatively, the spacer larger end 81, 86 can be positioned to face the head 61, 71 of the respective axle bolt. In this embodiment the frame sidewall 50*a*, 50*b* rides on the shoulder portion 63, 73 of the axle bolt 60, 70.

Figure 6:
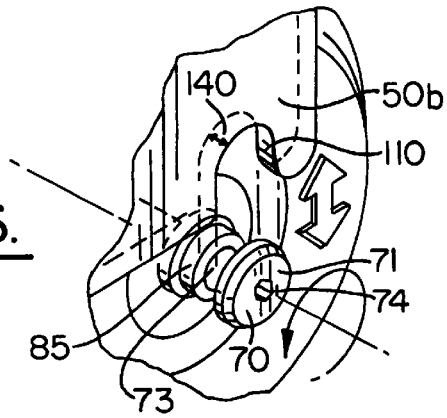
FIG. 6 is an enlarged partial perspective view of an alternative embodiment of an axle and roller to frame assembly according to the present invention.

As illustrated in FIG. 6, the axle 59 and wheel assembly can be preassembled and then mounted to the frame sidewalls 50*a*, 50*b*. In this embodiment, the frame sidewall includes an open-ended slot 110 which enables the wheel assembly to be slidably advanced into the slot. The axle head 71 and a respective spacer 85 define a gap 130 therebetween. The sidewall 50*a* has a thickness 140 associated therewith. The wheel assembly gap 130 is sized and configured to have an interference fit with the frame sidewall. As such, the wheel assembly is slidably inserted into the slot 110 and frictionally engaged with the frame sidewall. Further, upon assembly, the frame 14 forces the spacer large-end portion 81, 86 away from the sidewall 50*a*, 50*b* into the cavity 120 causing the bearing component 90 and wheel 16 to be snugly secured between the opposing axle bolt 60, 70 and spacer 80, 85.

Alternatively, the axle 59 can be assembled to the frame 14 prior to completing the wheel assembly. In this embodiment, the frame sidewalls 50*a*, 50*b* can include any number of alternatively configured openings for receiving the axle bolt head. One example of a suitable opening is a circular opening typically introduced by stamping or drilling into a sidewall. To assemble the axle 59 and wheel 16 to this frame configuration, the axle first bolt 60 is inserted into the opening such that the head 61 is positioned laterally of the frame sidewall 50*a* or cavity 120. The shaft 65 can be threadably engaged to the first bolt 60 either prior or subsequent to the insertion into the sidewall 50*a*. A spacer 80 and a bearing component 90 (and associated wheel) are positioned on the first bolt and shaft assembly. Subsequently, the second bolt 70 with a second spacer 85 is inserted through the opposing sidewall 50*b* in an axially aligned opening and engaged with the opposing side of the shaft 67. Of course, as described above, the spacers can be built into the frame sidewalls or, alternatively, the spacing associated therewith can be provided by the shape of the frame sidewall itself.

In an additional embodiment, the axle of the present invention can be employed as an attachment component in the assembly of the frame thereby enabling a strong, secure, and convenient attachment structure. For example, the axle 59 which can be sized and configured to act as the attachment component to provide the attachment means for the frame platform 15 to the sidewalls 50*a*, 50*b* or other frame components, such as the boot to frame attachment. Thus, in one alternative embodiment, a plurality of the "axles" can function as attachment devices 59 which are transversely inserted into the frame platform openings 48 instead of one or more of the transversely inserted bolts 49 typically employed to attach the sidewalls 50*a*, 50*b*, as described above.

Figure 7:
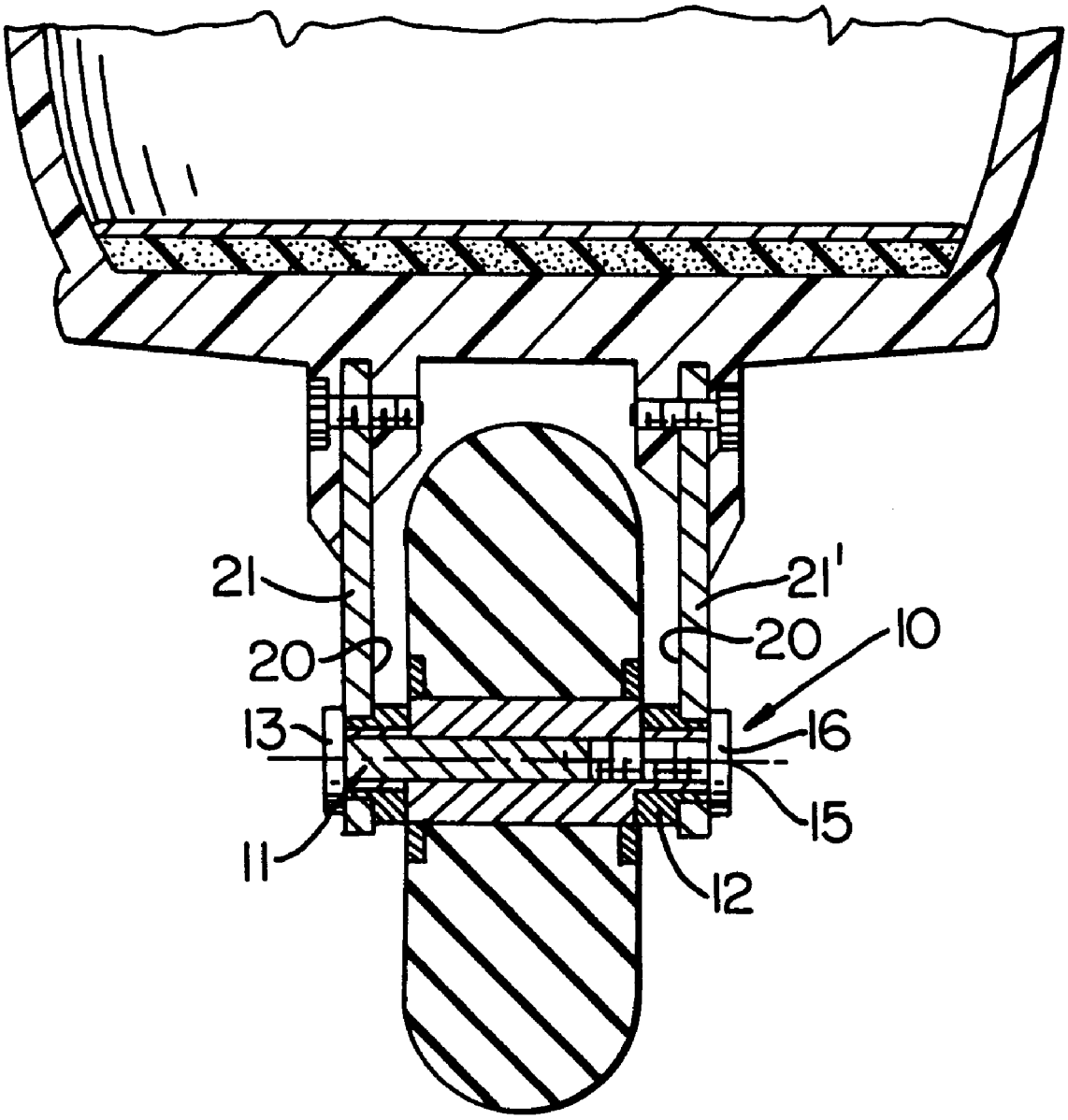
FIG. 7. (PRIOR ART)
FIG. 7 is a sectional view of a prior art two-piece axle.

Some of the advantages of the axle of the present invention can be seen by comparison with conventional in-line skate axles. As illustrated in FIG. 7, a representative prior art two-piece axle 10 includes an integral first member 11 with a barrel like portion which extends across the length of the cavity 20 defined by the two sidewalls 21, 21'. The first member includes an internal threaded portion 12 which receives a second member 15. Each of the first and second members have heads 13, 16 which are positioned on the outer surfaces of the sidewalls to secure the axles thereto. The sidewall 21' rides on a relatively thin portion of the member 15, which places this thin section of the member 15 at a high stress point. In contrast, the axle of the present invention adds material (in the form of the shoulder 63 of the bolt 60) in high stress areas.

Further, the prior art bolt heads do not typically provide enough material to allow a deepest hex head configuration therein. The present invention advantageously includes bolt heads which allow deepest hex head recesses therein. Additionally, unlike the present invention, when high strength, low weight materials such as titanium are employed in the prior art bolt components, the cost of the axle dramatically increased because the shaft and bolt are integrally formed. In addition, unlike the present invention, any frame size variation generally requires stocking frame model dictated multiple axle components, potentially increasing assembly time and inventory costs.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that, modifications to the disclosed embodiments, as well as other embodiments, are intended to be included within the scope of the appended claims. The invention is defined by the following claims, with equivalents of the claims to be included therein.

That which is claimed is:

1. An axle for an in-line skate, comprising:

a first bolt having opposing head and end portions and a shoulder disposed therebetween, wherein said shoulder is sized and configured to be received within a corresponding receptacle formed in a first sidewall of an in-line skate frame, and said end portion is threaded;

a cylindrical shaft having opposing end portions, one of said end portions being threadably engaged with said first bolt end portion, wherein said cylindrical shaft comprises an outer surface with a substantially uniform diameter;

a second bolt configured to be received within a corresponding receptacle formed in a second sidewall of an in-line skate frame having opposing head and end portions and a shoulder disposed therebetween, said end portion threadably engaged with said shaft end portion opposite said first bolt, wherein said shoulder is sized and configured to be received within a corresponding receptacle in the in-line skate frame;

a bearing sleeve adapted to receive said cylindrical shaft, said bearing sleeve having a length substantially equal to the length of said cylindrical shaft; and first and second spacers, each spacer having an inner cylindrical portion for receiving a portion of said shoulder of a respective one of said first and second bolts therein, wherein each spacer is sized and configured to reside on a portion of a respective one of said first and second bolt shoulders and has a radial portion extending between a respective one of the first and second sidewalls and said bearing sleeve such that an inner end of each of the radial portion of said spacers contacts said bearing sleeve and an outer end of the radial portion of each of said spacers contacts a respective one of the first and second sidewalls, wherein said cylindrical shaft has opposing ends which abut respective inner ends of said first and second bolt shoulders when said bolt end portions are received within said cylindrical shaft.

2. An axle for an in-line skate according to claim 1, wherein said second bolt has the same configuration as said first bolt.

3. An axle according to claim 1, wherein said first bolt head portion includes a recess which is configured to capture a hex head assembly tool.

4. An axle according to claim 1, wherein said first bolt and shaft are formed of different materials.

5. An axle according to claim 4, wherein said first and second bolts are formed of the same material.

6. An axle according to claim 4, wherein said bolt is formed of steel and said shaft is formed of aluminum.

7. An axle according to claim 4, wherein said bolt is formed of titanium and said shaft is formed of aluminum.

8. An axle according to claim 1, wherein said first bolt shoulder and threaded portion have substantially the same length.

9. An axle for an in-line skate according to claim 1, wherein at least one of said first and second bolt corresponding receptacles is defined by a slotted aperture with an open end positioned on a downward edge portion of each of said first and second sidewalls, and wherein said axle is configured to enter said slotted aperture open end such that one of said sidewalls resides over said first shoulder bolt portion and the other of said sidewalls resides over said second shoulder bolt portion to thereby attach a roller to said frame of an in-line skate.

10. An axle according to claim 1, wherein each of said spacers laterally extends into one of said first and second sidewall receptacles.

11. An in-line skate, comprising:

a boot having a sole surface with toe and heel portions;

a frame platform having an upper face and a lower face, said upper face being affixed to said boot sole surface, comprising:

first and second downwardly extending sidewalls having opposing top and bottom portions, said bottom portions including a plurality of receptacles formed therein transversely disposed along the length of said sidewalls, said first and second sidewalls being disposed on opposing sides of and attached to said frame platform lower face via respective top portions to define a cavity therebetween, wherein said receptacles of said first and second sidewalls are aligned, and wherein at least one of said aligned receptacles is defined by a pair of corresponding open-ended downwardly extending slots;

a plurality of axles, each received into corresponding aligned receptacles of said first and second sidewalls and extending across said cavity, at least one of said axles comprising;

a first bolt having opposing head and end portions and a shoulder disposed therebetween, wherein said shoulder is received within a corresponding receptacle in one of said first and second sidewalls;

a cylindrical shaft having opposing end portions and an outer surface with a substantially uniform diameter, one of said end portions threadably engaged with said first bolt end portion; and a second bolt having opposing head and end portions and a shoulder disposed received by a corresponding receptacle of the other of said first and second sidewalls, said end portion threadably engaged with said shaft opposite said first member;

a bearing sleeve adapted to receive said cylindrical shaft, said bearing sleeve having a length substantially equal to the length of said cylindrical shaft; and first and second spacers, each spacer having an inner cylindrical portion for receiving a portion of said shoulder of a respective one of said first and second bolts therein, wherein each spacer is sized and configured to reside on a portion of a respective one of said first and second bolt shoulders and has a radial portion extending between a respective one of the first and second sidewalls and said bearing sleeve such that an inner end of each of the radial portion of said spacers contacts said bearing sleeve and an outer end of the radial portion of each of said spacers contacts a respective one of the first and second sidewalls, wherein said cylindrical shaft has opposing ends which abut respective inner ends of said first and second bolt shoulders when said bolt end portions are received within said cylindrical shaft; and a plurality of wheels, each being rotatably mounted on a corresponding one of said axles between said first and second sidewalls.

12. A skate according to claim 11, wherein said axle first bolt shoulder has a length defined between said head and end portions, said first sidewall has a thickness, said shoulder length is greater than said first frame sidewall thickness, and said shoulder is positioned to extend beyond said sidewall a predetermined distance from said first sidewall into said cavity.

13. A skate according to claim 11, wherein said first bolt end portion is spaced-apart from said first frame sidewall within said cavity.

14. A skate according to claim 13, wherein said second bolt is configured to be interchangeable with said first boll.

15. A skate according to claim 13, wherein said second bolt is a replicant of said first bolt.

16. A skate according to claim 13, wherein said first bolt head portion includes a recess which is configured to capture a hex head assembly tool.

17. A skate according to claim 13, wherein said first bolt and said shaft are formed of different materials.

18. An axle according to claim 13, wherein said first and second bolts are formed of the same material.

19. A skate according to claim 11, wherein each of said spacers laterally extends into one of said first and second sidewall receptacles.

* * * * *